United States Patent [19]

Kankaanpää

[11] 4,188,262

[45] Feb. 12, 1980

[54] METHOD FOR DEWATERING PAPER IN A PAPER MACHINE PRESS SECTION

[75] Inventor: Matti Kankaanpää, Tapiola, Finland

[73] Assignee: Valmet, Finland

[21] Appl. No.: 771,149

[22] Filed: Feb. 23, 1977

Related U.S. Application Data

[63] Continuation-in-part of Ser. No. 544,952, Jan. 23, 1975, abandoned, which is a continuation-in-part of Ser. No. 310,805, Nov. 30, 1972, abandoned.

[51] Int. Cl.[2] ..... D21F 2/00; D21F 3/04

[52] U.S. Cl. ..... 162/205; 162/305; 162/306; 162/307; 162/360 R

[58] Field of Search ..... 162/205, 305, 306, 358, 162/360 R, 307, 360 DP

[56] References Cited

U.S. PATENT DOCUMENTS

| | | | |
|---|---|---|---|
| 2,653,523 | 9/1953 | Hornbostel | 162/360 R |
| 2,694,346 | 11/1954 | Goodwillie | 162/307 X |
| 3,595,745 | 7/1971 | Cronin | 162/306 |
| 3,861,996 | 1/1975 | Dorfel | 162/306 X |
| 4,075,056 | 2/1978 | Ely et al. | 162/305 |
| 4,086,131 | 4/1978 | Rempel et al. | 162/360 R |

OTHER PUBLICATIONS

Albany International Corp., *Paper Machine Felts and Fabrics,* 1976, pp. 65–67.

John F. Atkins (Editor), *Paper Machine Wet Press Manual,* Tappi Monogram Series No. 34, 1972, pp. 42–44.

J. Newell Stephenson (Editor-in Chief), *Pulp and Paper Manufacture: Manufacturing and Testing of Paper and Board,* 1953, vol. 3, p. 511.

*Primary Examiner*—Richard V. Fisher

*Attorney, Agent, or Firm*—Steinberg & Blake

[57] ABSTRACT

A method for feeding a paper web from a forming wire and for dewatering the web including the steps of urging a pick-up felt against the web on the forming wire, adhering the web by suction to the surface of a pick-up felt, transferring the web onto a transfer felt which wraps a transfer roll, the latter being contiguous to the pick-up roll, passing the web on the transfer felt to a first dewatering press nip formed by an upper suction press roll and a cavernous surface lower press roll, the latter operating inside the transfer felt loop while the suction roll operates inside its own felt loop, pressing the web in the first press nip to dewater the web in two directions i.e. towards the suction roll and towards the cavernous surface roll, adhering the web to the suction roll felt surface, transferring the web to a second dewatering press nip formed by the suction roll and by a smooth surface press roll, pressing the web in the second nip to dewater the web only towards the suction roll, detaching the web from the suction roll felt and adhering the same to the surface of the smooth surface press roll and transferring the web to a following web treatment phase.

5 Claims, 2 Drawing Figures

METHOD FOR DEWATERING PAPER IN A PAPER MACHINE PRESS SECTION

Figure 1:
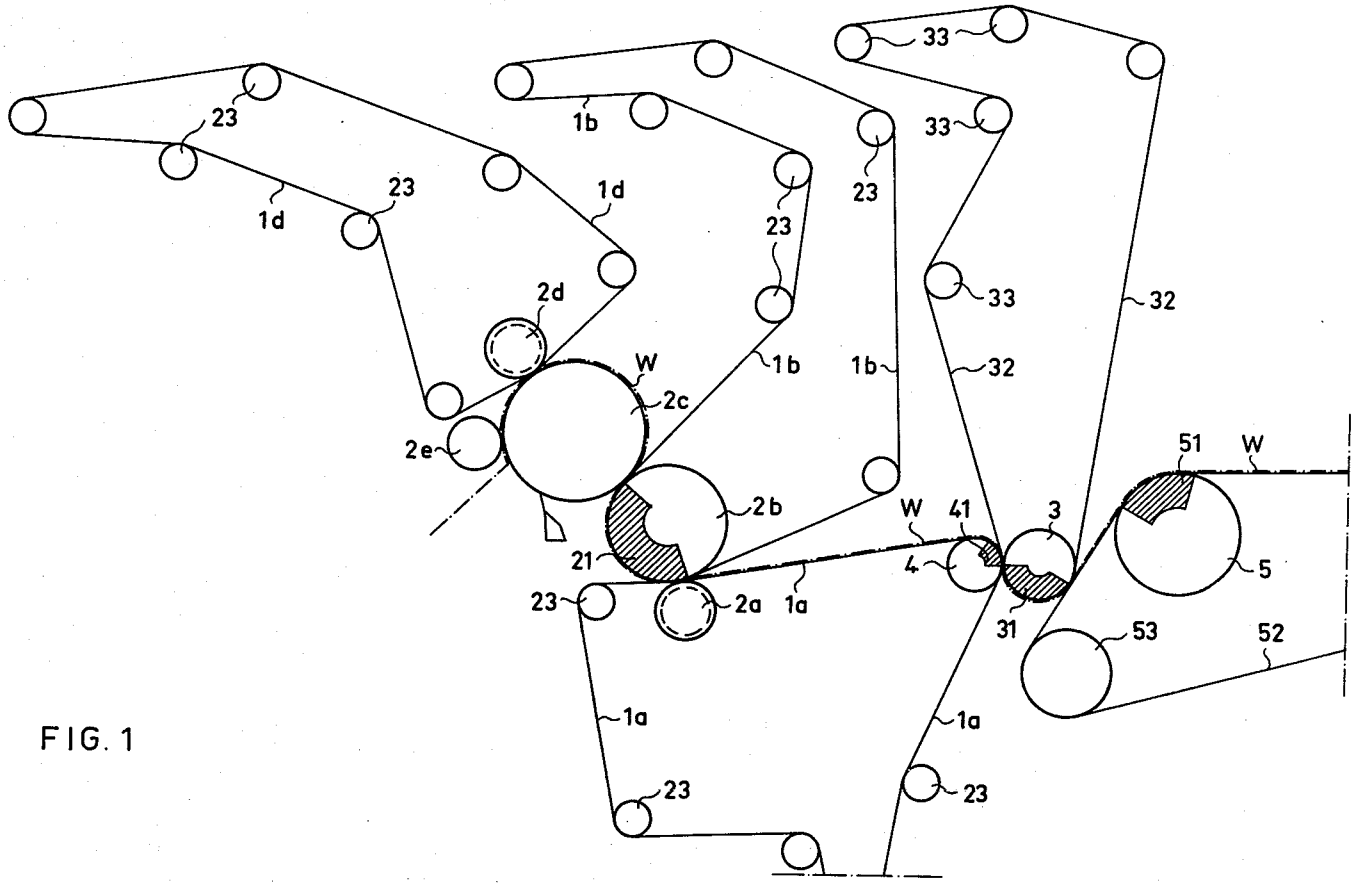

The present invention is a continuation-in-part of my application Ser. No. 544,952, filed Jan. 23, 1975 (now abandoned), which is a continuation-in-part of my copending patent application, Ser. No. 310,805, filed Nov. 30, 1972 (now abandoned).

This invention relates to a method in the press section of a paper making machine.

The paper making machines, according to the above patent application (i.e., Ser. No. 310,805), have a press section, wherein the paper or paperboard web is conducted through nips defined by press rolls, in so-called closed conduction, so that the web is continually supported adherent either to a felt or to the surface of a roll. In this procedure, the web is detached from the wire and subsequently conducted through at least two press nips thus dewatering the web. The first of these dewatering nips is defined by two press rolls of which one is a suction roll and the other a cavernous surface roll. Each roll is provided with a felt, and the second nip is defined by a roll with smooth plain surface, and a suction roll belonging to the first press nip.

More particularly, in the above type press part, the paper web is detached from the Fourdrinier wire with the aid of a pick-up roll and pick-up felt. The web then becomes adherent to the lower surface of said felt lapping the pick-up roll. This pick-up felt conveys the web further to a first dewatering press nip. There is a suction roll belonging to this press nip which is located within the same felt loop as the pick-up roll.

In the course of practical experience with these prior art press sections, it has been observed that they have certain drawbacks. Namely, in these press sections, the run of the pick-up felt between the Fourdrinier wire and the first dewatering nip is substantially horizontal and relatively long. On this run, the web is adherent to the lower surface of the pick-up felt merely by the effect of surface tension force. The surface tension force per unit area of the web must exceed the wet basis weight of the web. Otherwise, the web would separate from the surface of the felt and cause a production shut-down. It follows that a pick-up transfer of this kind is most suitable for use in the production of comparatively thin paper grades. It is not always usable when the paper machine must handle a web which is heavy, either due to its inherent basis weight or to its water content. In order that the surface tension force might be operative, it is furthermore necessary that there should be a good contact between the web and the felt. Moreover, between the web and the felt, there should be an appropriate water interface. This implies that the pick-up felt has to meet certain requirements of textile technology, for example, as regards its surface structure and its porosity. It should be noted, however, that, in the described conventional pick-up system, the same felt serves both for the transfer of the sheet from the Fourdrinier wire to the press nip, and for the dewatering process in the press nip in question. Those characteristics of the felt which are advantageous for detaching the web from the wire and transporting it forward are not always required in the pressing process for dewatering the web.

Moreover, because there must be a sufficient water interface on the surface of the pick-up felt to make the adhesion and transfer possible, this means that the pick-up felt must operate relatively wet. The fact that the wetness of the pick-up felt which carries the web to the first dewatering nip is wet, naturally influences the efficiency of the water removal in this nip. The water amount, which is pressed out from the web in the nip between the press rolls, is absorbed by the felts. It is conceivable that if the felts are relatively wet, they cannot easily receive as large amount of water as if they are relatively dry. Therefore, a system in which the pick-up felt is brought to the first dewatering nip is not advantageous.

For the above reasons, a conventional pick-up transfer is not a perfect process considering the operation of the paper machine, and also the quality of the paper thus produced will have.

An object of the present invention is to improve existing press sections.

Another object of the present invention is to improve the efficiency of operation of the paper machine, and particularly in those instances in which paper grades with a relatively greater thickness are made.

It is another object to improve the operation of the press section with regard to its dewatering efficiency, at the same time maintaining the high quality requirements imposed on the surface of the paper and its structure.

According to the design of the present invention, the runability of a paper machine is improved by reducing web breaks. This is achieved by an arrangement where the sheet is mechanically supported at all times while passing the press section. This makes web breaks at the press section almost impossible. By mechanically supporting the sheet, the sheet as it passes the press section either is supported from below by the felt or a roll surface or is adhered to the felt by suction.

The sheet mechanical support is to be distinguished from a physico-chemical support effected by surface tension forces utilized in common pick-up systems. When the sheet is conventionally transferred from the pick-up point to the first press nip, the sheet is adhered to the lower surface of the felt by surface tension only. If a heavy sheet is produced the gravity may be stronger than the surface tension in which case the sheet drops from the felt and causes a break. This problem is eliminated by the present invention.

Another factor influencing the runnability of a paper machine is the dewatering capacity of its press section. In the present invention this feature is improved as follows. Since the pick-up felt must operate relatively wet so that surface tension forces might be effective, this has a consequence that in the conventional pick-up transfer systems, the drainage in the first nip is not optimum. According to the present invention the effective drainage is achieved by providing both the pick-up roll and the upper roll of the first press nip with separate felts. The wet pick-up felt is not led to the first nip. In place of the pick-up felt in the first nip is said upper roll felt. This felt, when entering the nip, is relatively dry and has dewatering capacity compared with the pick-up felt.

Thus, in the first press nip pressing of the sheet takes place between two felts. In addition, both rolls forming this nip are water-receiving rolls, and have recessed surfaces. A suitable combination is to use a suction roll as the upper roll and a grooved roll as the lower roll. This results in the advantage that the drainage can take place simultaneously to two directions, that is symmetrically. The symmetrical drainage has a great effect on the quality of the paper. This leads to an even dispersion of fillers and fines in the cross direction of the sheet.

As the sheet is pressed between two felts, the width of the nip becomes somewhat broader than in cases where only one felt is used in the press nip. The drainage is effective because the water is removed simultaneously in two directions, and a wide nip means longer pressing time and correspondingly increased drainage.

Between the two felts the pressing effect on the sheet structure is relatively gentle although heavy press loads are used. There is no danger of sheet crushing and the optimal sheet strength is obtained.

In accomplishing the above outlined objectives, the press part according to the present invention is designed so that the web is detached from the Fourdrinier wire by the aid of a pick-up roll which operates within a pick-up felt loop, wrapping only the pick-up roll, so that after its detachment from the wire, the web adheres to the lower surface of the pick-up felt over its part substantially consistent with the suction sector of the pick-up roll. The web is subsequently detached from the pick-up felt by means of a suction transfer roll operating within a felt loop of its own. The web is transferred onto this transfer felt in such a way that after the last-mentioned point of detachment, the web will be supported from below by the transfer felt. The transfer felt of the suction transfer roll conveys the web to the first dewatering press nip, and the pick-up felt is not involved in the first dewatering press nip.

The improvement in the operating efficiency of the paper machine of the present invention arises from the practice of the invention and there are more extensive possibilities of selection of the different felts which are used in the press part as regards their quality and characteristics. As regards, firstly, the pick-up felt, it can be stated that in the prior art, according to the grandparent application Ser. No. 310,805, the same felt served as both the pick-up and the press felt in the first and second nip. Therefore it was necessary, during the choice of the pick-up felt and in the choosing a suitable felt quality, to consider simultaneously of the following factors:

- the pick-up transfer process as such and the adherence of the web to the pick-up felt;
- the pressing process and dewatering in the first nip;
- the pressing process in the second nip; and
- the effect of the felt on paper marking and structure of the paper.

Those characteristics which a pick-up felt is required to possess in view of an optimal pick-up detachment from the wire, or those surface characteristics of the felt which are necessary preconditions ensuring that the web remains adherent to the lower surface of the felt, are quite often greatly different from such felt characteristics which are desirable from the viewpoint of an efficient dewatering action in the press nip.

When the present invention is used, it is only necessary to pay attention to two functions of the pick-up felt;

(a) the detaching of the web from the wire and its transfer onto a felt belonging to the first nip;

(b) the influence of the pick-up felt structure on the surface of the paper or paperboard.

These circumstances greatly facilitate the felt problems encountered by the paper maker. With the procedure of the present invention, it is possible to select for the pick-up felt such thickness and porosity parameters which are optimal with regard to the suction pick-up process. It is thus possible to select a surface structure of the felt which is favorable in view of the surface quality of the paper that is being produced. A felt may be selected which will provide the longest possible service life.

Secondly, as regards the transfer felt, its role in the present press construction generally corresponds to that of the "second felt" of the grandparent application. The felt quality may in most cases remain unaltered.

Thirdly, with regard to the suction roll felt belonging to the first nip, it can be selected solely bearing in mind the most efficient water removal process possible. This is a separate felt and takes part in the first and second dewatering press nips. It should be designed so that it can receive as large an amount of water as possible. As to its surface structure, it is not necessary that the web adhere to it because of surface tension. The web is connected to this felt only in the suction (roll) sector between the first and the second nips, and the vacuum of the suction roll maintains the web adhered to this felt.

After the web has been detached from this felt in the second water removing nip of the press section, this felt runs alone guided by the felt guiding rolls. This felt is equipped as all the other press section felts with a kind of felt conditioner which is of the usual design, such as, for example, a felt wringer press. The felt is relatively dry in the stage when it again is threaded to the first nip.

The invention will appear more clearly from the following detailed description when taken in connection with the accompanying drawings, showing by way of example only, preferred embodiments of the inventive ideas.

As the invention refers to a method in a paper machine of dewatering the web through pressing, the press section in question is only schematically shown. The press part frame structure is omitted for clarity. Also some devices inevitably belonging to press part and obvious to those skilled in the art, as felt stretchers, felt guiding devices and felt conditioners, which may be of any common construction, are not shown.

Figure 2:
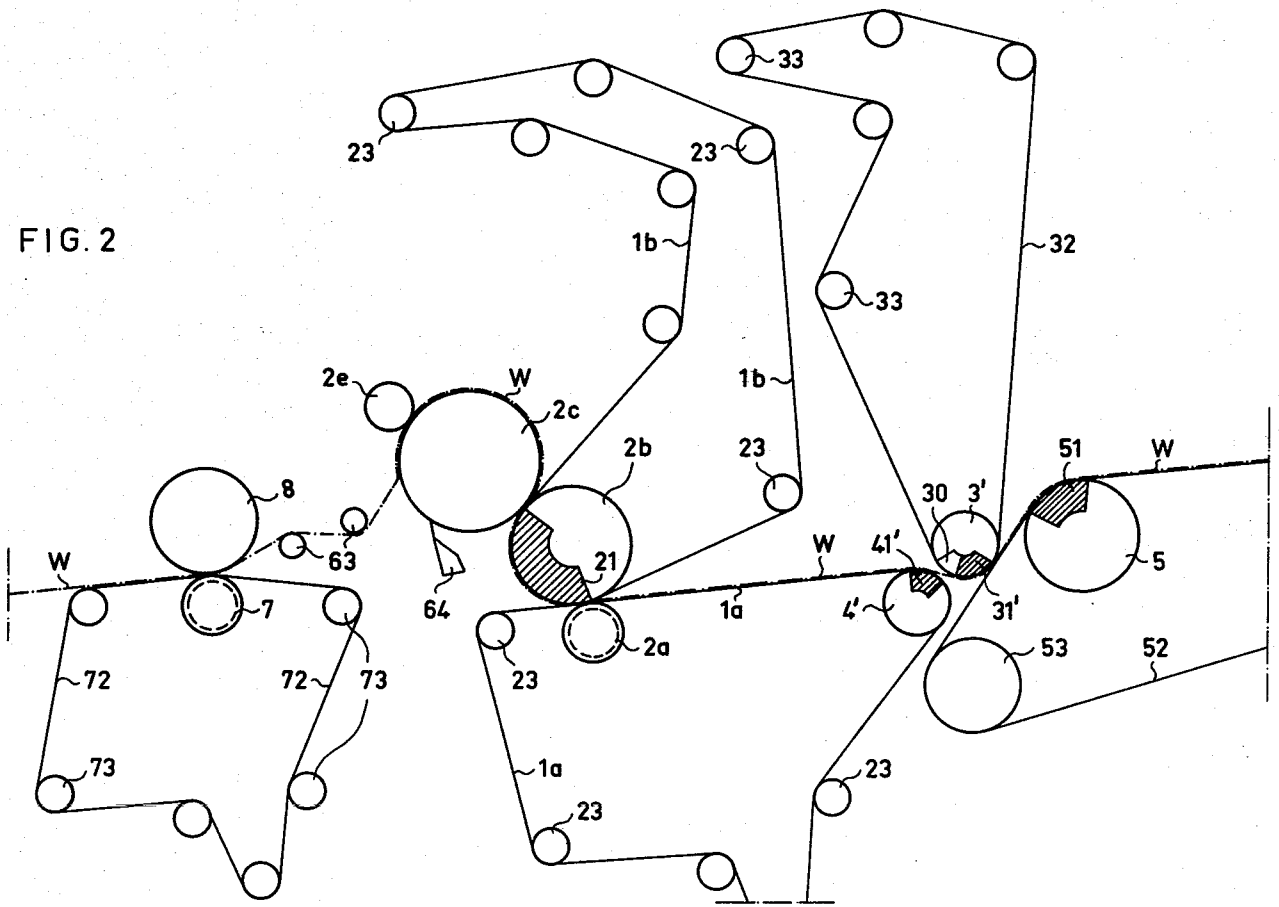

In the drawings wherein similar reference characters denote similar references throughout the two views:

FIG. 1 is a diagram illustrating a press section of the present invention having three dewatering press nips; and FIG. 2 is a similar diagram showing an arrangement wherein the third dewatering nip consists of a separate pair of press rolls.

Referring to FIG. 1, a paper web W is detached, between rolls 5 and 53 from a wire 52 by the use of a pick-up roll 3, which operates within its own felt loop 32. Web W is kept adherent to felt 32 by a suction zone 31 prevailing within roll 3. Roll 3 is opposed by a transfer suction roll 4, which operates within the loop of its own felt 1*a*. Transfer suction roll 4 also has a suction zone 41. At nip $\frac{3}{4}$ defined by pick-up roll 3 together with suction transfer roll 4, web W is transferred from felt 32 onto felt 1*a*. It should be particularly noted that at nip $\frac{3}{4}$, no appreciable if any pressure is exerted on web W; this is significant in view of the retention of porosity in the finished paper.

The mutual position of the pick-up roll and the transfer roll may vary depending e.g. on the design of the wire section, to which the press section according to the invention is incorporated. The center of the transfer roll can be higher, on the same level or lower than the center of the pick-up roll. Correspondingly the distance the web travels adhered onto the surface of the pick-up felt starting from the point where the web is transferred from the forming wire to the pick-up felt as far as to that point where the web again is detached from the pick-up felt, may be in the range of 100–180 degrees of an arc measure along the pick-up roll surface. In the design according to FIG. 1 this arc is about 140°.

Pick-up roll 3 and transfer suction roll 4 are preferably of small diameter and of light construction, because, in nip ¾ defined by them, no pressure or loading is applied because this nip is not intended to be a dewatering nip.

When the web has been transferred to felt 1*a*, this felt conveys web W to a first dewatering nip 2*a*/2*b* of the press section, which is defined by rolls 2*a* and 2*b*, and in which nip 2*a*/2*b* pressing is accomplished between two felts 1*a* and 1*b*. The roll 2*a* is a cavernous surface roll, and the roll 2*b* is a suction roll with either a continuous suction zone 21 or with a plurality of suction compartments, located, for example, only at the regions of nips 2*a*/2*b* and 2*b*/2*c*. It must be emphasized that the suction roll is wrapped by its own suction roll felt 1*b*. This felt is equipped with felt conditioners of any common type (not shown) by means of which the felt is continuously washed and dewatered so that it is clean and relatively dry when entering the first nip. Adherent to the surface of felt 1*b*, the web travels to a second dewatering nip 2*b*/2*c*, defined by rolls 2*b* and 2*c*. Roll 2*c* has a smooth surface and is without felt, so that the dewatering in nip 2*b*/2*c* is in the direction towards suction roll 2*b*. At nip 2*b*/2*c*, web W is transferred from felt 1*b* onto roll surface 2*c*, which conveys it to a third nip 2*c*/2*d* of the press system, where roll 2*d* is cavernous surface roll and has been provided with a felt 1*d* of its own. From third nip 2*c*/2*d*, the web may be conducted in conventional manner to the following web treatment e.g. drying section.

It is possible, however, to fit additional nips operating against roll 2*c*. These may alternatively be provided with felts, if an enhanced dewatering action is desired, or they may be without felt, as is a roll 2*e*, which has been provided with a relatively soft plain coating merely in view of a smoothing effect.

The so-called closed transfer of a web from one felt to another usually implies that these felts are in a nip contact to each other. This contact can of course be achieved without practically any pressing.

In certain cases the web transfer according to the present invention is possible without any contact between the felts. One such embodiment of the invention is shown in FIG. 2. In this case the transfer roll 4' is located at a lower level than the pick-up roll 3', oblique beneath it, so that there is a gap between the pick-up felt 32 and the transfer felt 1*a*. After the web W has passed the suction section 31' of the pick-up roll 3 the web W is easily e.g. due to centrifugal force detached from the felt 32 and transferred onto felt 1*a*. The pick-up roll suction sector 31' can be in this case relatively narrow, corresponding a center angle of about 60°–90°. In some cases it is advisable to provide the sucton roll with a blowing compartment 30 following the suction compartment for securing the transfer. The roll 4' is shown to be provided with a suction sector 41'. The suction however is not always necessary and the roll 4' may have similar construction as felt rolls 23.

As explained earlier the mutual positions of pickup roll 3' and transfer roll 4' and the whole geometry relating to the web transfer point between said rolls is dependent from the wire section design and further from the roll diameters used at this part of paper machine.

Although there is a gap between pick-up felt 32 and transfer felt 1*a* there is practically no risk for a web break if the position of the transfer roll 4' is properly lower in relation to the pick-up roll 3'. This kind of web transfer corresponds thus the closed transfer principle.

Further, referring to the embodiment shown in FIG. 2, the press section comprises, instead of the press nip 2*d*/2*c* a separate pair of rolls 7 and 8, which define a press nip. Roll 7 has a cavernous surface and has been provided with a felt 72 of its own. Roll 8 is provided with smooth surface. Web W is detached from roll 2*c* in conventional manner and conducted, guided by rolls 63, to the nip defined by rolls 7 and 8.

The felts of the systems shown in the drawings have been denoted with reference numerals 1*a*, 1*b*, 1*d*, 32, 72. The felt guiding rolls, correspondingly, with numerals 23, 33, 73. The suction zones of the different rolls have been indicated by numerals 21, 31, 31', 41, 41', 51 and the cleaning doctor or roll 20 has the reference numeral 64.

The present invention involves a new and useful method combination which cannot be found in prior art. The features are as follows:

(a) The pick-up roll has a separate felt loop, which is not led to a dewatering nip.

(b) The first dewatering press nip is double felted.

(c) The upper roll of the first nip has a separate felt which, when entering the first nip, is relatively dry.

(d) There are further press nips after the first nip in compact no-draw press unit.

As to the total dewatering capacity of the inventive press design, the drainage can be carried on at the additional nips (second and third) under quite a high pressing pressure without damage to the sheet because the web has already become sufficiently solidified in the first nip due to this nip's operation principle. Thus, although the drainage in these nips takes place in only one direction, this has no harmful effect on the symmetrical structure of the paper web.

While only a few embodiments of the present invention are shown and described, it will be obvious that many changes and modifications may be made without departing from the spirit and scope of the claims.

What is claimed is:

1. A method in a paper machine press section for dewatering a paper or paperboard web and for feeding said web from a forming wire of said paper machine through the press section, the web being substantially all the time supported by the surface of a felt or a roll comprising the steps of:

urging a pick-up felt by means of a pick-up suction roll against said web lying on said forming wire;

detaching the web from said forming wire and adhering the web by suction to the surface of said pick-up felt on which the web during its travel onwards is kept on an area defined by a suction sector of said pick-up roll;

detaching the web from said pick-up felt and transferring the web onto a transfer felt of a transfer felt loop while wrapping a transfer roll, said transfer roll operating inside the transfer felt loop contiguous to said pick-up roll;

passing the web lying on the surface of the transfer felt to a first dewatering press nip of the press section, which nip is formed by an upper suction press roll and cavernous surface lower press roll, wherein the cavernous roll operates inside said transfer felt loop and the suction press roll operates inside its own felt loop formed by a suction roll felt, said suction roll felt only lapping said suction press roll and not contacting said web prior to said web reaching said first dewatering press nip; pressing the web in said first press nip to dewater the web in two directions partly towards the suction roll whereby the water is removed through the suction roll felt and partly towards the cavernous surface roll so that the water is also removed from the web through the transfer felt;

adhering the web to the suction roll felt surface due to the effect of the suction prevailing inside said suction press roll;

transferring the web adherent to the suction roll felt surface to the second dewatering press nip of the press section, said second nip being formed by the suction roll of said first nip and by a smooth surface press roll;

pressing the web in said second nip so as to dewater the web only towards said suction roll whereby the water removed from the web is transferred into the suction roll felt;

detaching the web from said suction roll felt utilizing the adhesion force of the surface of said smooth surface press roll and adhering the web on said surface; and transferring the web being adherent to the surface of said smooth surface roll to a following web treatment phase.

2. The method according to claim 1 comprising the step of applying suction to the web lying on the transfer felt while wrapping the transfer roll.

3. The method according to claim 1 comprising the step wherein the water, which in the first nip is from the web transferred to the suction roll felt, is partly moved by suction into the suction roll between the first nip and the second nip.

4. The method according to claim 1 wherein said following web treatment phase comprises pressing the web in a third dewatering press nip, said nip being formed by said smooth surface roll and a further cavernous surface roll operating inside a fourth felt loop of the press section.

5. The method according to claim 1 wherein said following web treatment phase comprises pressing the web in a smoothing press nip formed by said smooth surface roll of said second nip and a further smooth surface roll which has a diameter smaller than the first mentioned smooth surface roll, the small diameter roll having a relatively soft covering.

* * * * *